US006085389A

United States Patent [19]

Brabant et al.

[11] Patent Number: 6,085,389

[45] Date of Patent: Jul. 11, 2000

[54] DEVICE FOR FORMING A SHEET-LAP OF FIBRE TUFTS, IN PARTICULAR FOR LOADING A TEXTILE MACHINE SUCH AS A CARD

[75] Inventors: Marc Brabant; Xavier Catry, both of Hem; Christian Vanbeselaere, Tourcoing, all of France; Reinhold Doring, Dulmen, Germany

[73] Assignee: Thibeau, Tourcoing, France

[21] Appl. No.: 09/269,902

[22] PCT Filed: Jul. 31, 1998

[86] PCT No.: PCT/FR98/01721

§ 371 Date: Apr. 2, 1999

§ 102(e) Date: Apr. 2, 1999

[87] PCT Pub. No.: WO99/07929

PCT Pub. Date: Feb. 18, 1999

[30] Foreign Application Priority Data

Aug. 4, 1997 [FR] France ..... 97 10168

[51] Int. Cl.[7] ..... D01G 15/40

[52] U.S. Cl. ..... 19/105; 19/204; 406/82

[58] Field of Search ..... 19/65 A, 97.5, 19/105, 200, 204, 205, 240; 406/45, 82, 93, 70, 157, 171

[56] References Cited

U.S. PATENT DOCUMENTS

| | | | |
|---|---|---|---|
| 4,387,486 | 6/1983 | Keller et al. | 19/105 |
| 4,394,790 | 7/1983 | Keller et al. | 19/105 |
| 4,403,374 | 9/1983 | Wood | 19/105 |
| 4,404,710 | 9/1983 | Wood | 19/105 |
| 4,476,611 | 10/1984 | Keller et al. | 19/105 |
| 4,520,530 | 6/1985 | Pinto | 19/105 |
| 5,197,162 | 3/1993 | Pinto et al. | 19/105 |

FOREIGN PATENT DOCUMENTS

| | | |
|---|---|---|
| 0 113 819 | 7/1984 | European Pat. Off. . |
| 1435978 | 6/1966 | France . |
| 32 39 524 | 7/1983 | Germany . |
| 39 16 986 | 11/1990 | Germany . |
| WO 90/12909 | 11/1990 | WIPO . |

*Primary Examiner*—Michael A. Neas
*Assistant Examiner*—Gary L. Welch
*Attorney, Agent, or Firm*—Wolf, Greenfield & Sacks, P.C.

[57] ABSTRACT

Apparatus for forming a lap of stock fibers, in particular for continuously loading a textile machine such as a card, the apparatus comprising a feed chimney (4) which is open at its top and bottom ends **(4*a*, 4*b*) and which is provided with an air exhaust opening (9) of given section or with a plurality of air exhaust openings distributed over a given section. The exhaust opening(s) (9) opening out directly into an expansion chamber (13). The air inside the expansion chamber is taken up by suction via a air manifold chamber (18*a*) which is designed to have low pressure established therein, and which communicates with the expansion chamber (13) via an air takeup slot (14) which extends substantially over the entire width l of the section of the exhaust opening(s) (9) or via a plurality of air takeup openings which are distributed substantially over the entire width l of the section of the exhaust opening(s) (9)**.

20 Claims, 3 Drawing Sheets

DEVICE FOR FORMING A SHEET-LAP OF FIBRE TUFTS, IN PARTICULAR FOR LOADING A TEXTILE MACHINE SUCH AS A CARD

The present invention relates to apparatus for forming a lap of stock fibers, and more particularly intended for positioning upstream from a textile machine such as a card, for the purpose of feeding it continuously with textile material. The invention relates more particularly to an improvement relating to taking up the densifying air flow at the outlet from the feed chimney of such apparatus.

Apparatuses for forming a lap of stock fibers, such as those used for loading a card, usually comprise a feed chimney which is open at its top and bottom ends, and which is provided in its lower portion with one or more air exhaust openings. Such apparatuses also include means enabling the feed chimney to be fed via its open top end with stock fiber material, means for taking up the stock fiber material, which means are of the feed roller type located at the outlet from the bottom end of the feed chimney, and means for providing forced circulation of a flow of air for densifying the fiber material between the top portion of the feed chimney and the exhaust opening(s).

Manufacturers and users of the above-mentioned apparatuses are continually looking for ways of obtaining a lap at the outlet of the feed chimney that is of a thickness that is as uniform as possible over the entire width of the feed chimney. To this end, it is desirable in such apparatuses to obtain a distribution of densifying air within the feed chimney that is as uniform as possible, firstly by providing a system of baffles upstream from the feed chimney for the purpose of breaking up the flow of densification air and distributing it uniformly over the entire width of the inlet of the feed chimney, and secondly by taking up the densification air flow from the lower portion of the feed chimney over the entire width thereof, with the exhaust opening(s) extending substantially over all of said width.

The flow of densification air at the outlet from the feed chimney is taken up by suction into an air takeup duct, and is then either recycled in a closed circuit by being reinjected into the feed chimney, or else is exhausted to ambient air, possibly after being filtered.

German patent application DE-A-3239524 and the equivalent U.S. Pat. No. 4,394,790 teach interposing an expansion chamber between the suction takeup duct and the feed chimney. To prevent variations in the suction source which is connected to said expansion chamber via the air takeup duct having an effect on the level of fibers in the chimney, it is recommended in those publications to control the pressure inside the expansion chamber. This pressure control is obtained by providing means for admitting air into the expansion chamber so as to enable ambient air to be admitted selectively into the expansion chamber when the suction within the expansion chamber is excessive. In a particular variant, the air admission means are constituted by an opening fitted with a valve.

In presently known apparatuses, although the air is uniformly distributed at the inlet to the feed chimney, and although provision is made for densification air to be exhausted over the entire width of the feed chimney, there nevertheless remain in practice one or more zones across the width of the feed chimney where fibrous material accumulates preferentially inside the feed chimney, thereby spoiling the uniformity of the lap formed at the outlet from the chimney.

In particular, in the apparatus described in German patent application DE-A-3239524 or U.S. Pat. No. 4,394,790, the forced takeup of air inside the expansion chamber influences the flow of air at the outlet from the feed chimney, and thereby influences the level of fiber material inside the chimney.

The object of the present invention is to improve those prior apparatuses for forming a lap of stock fibers as to reduce, and if possible eliminate, the zones of preferential accumulation of material inside the chimney, thereby obtaining a lap that is more uniform across its entire width.

The solution of the invention consists essentially in seeking to improve the way in which the densification air flow is taken up by suction at the outlet from the feed chimney so as to minimize the influence of said suction takeup on the flow of air circulating inside the feed chimney.

The device of the invention for forming a lap of stock fibers is known, specifically from German patent application DE-A-3239524, insofar as it comprises a feed chimney open at its top and bottom ends, an expansion chamber communicating with the feed chimney via an air exhaust opening of given section of width l or via a plurality of air exhaust openings distributed over a given section of width l, means for taking up the air by suction from inside the expansion chamber, means enabling the feed chimney to be fed with stock fiber material via its open top end, means of the feed roll type for taking up the stock fiber material and disposed at the outlet from the bottom end of the feed chimney, and means for establishing a forced flow of densification air between the top portion of the feed chimney and the exhaust opening(s).

According to an essential characteristic of the invention, the means for taking up air by suction from inside the expansion chamber comprise an air distribution manifold chamber designed to be put at reduced pressure and communicating with the expansion chamber via an air takeup slot that extends over substantially the entire width l of the section of the exhaust opening(s), or via a plurality of air takeup openings distributed substantially over the entire width l of the section of the exhaust opening(s).

In apparatuses known in the state of the art, the Applicant has observed that the flow of densification air is always subjected to acceleration immediately on leaving the feed chimney, at least in the portion thereof that is the closest to the suction takeup ducts, which acceleration distorts parallel flow and gives rise to a local increase in the speed of the air flow even inside the feed chimney, thereby disturbing the uniformity of the flow of densification air inside the feed chimney. This disturbance to the densification air flow explains why fibers accumulate preferentially in certain zones of the feed chimney.

In comparison, in the apparatus of the invention, implementing a distribution chamber with an air takeup slot or a plurality of air takeup openings serves advantageously to obtain good distribution of the suction flow at the outlet from the expansion chamber and over the entire width of the expansion chamber corresponding to the width of the section of the air exhaust opening(s) putting the feed chimney into communication with the expansion chamber. As a result, the air take up at the outlet from the expansion chamber gives rise to very little change in the direction of the air flow speed vectors at the exhaust openings between the feed chimney and the expansion chamber. Taking up the air in this way therefore does not significantly modify the distribution of densification air inside the feed chimney, and thus has no significant effect on the distribution of fiber material within the chimney.

Preferably, the volume of the expansion chamber is large enough, and the air takeup openings or slot are far enough away from the exhaust opening(s), to establish a buffer zone inside the expansion chamber immediately at the outlet from the exhaust opening(s), which buffer zone extends at least over the section of the exhaust opening(s), and in which the air from the feed chimney is subjected to expansion so that air speed in the buffer zone decreases going away from the exhaust opening(s).

Other characteristics and advantages of the invention will appear more clearly on reading the following description of a preferred embodiment of apparatus of the invention, which description is given by way of non-limiting example and with reference to the accompanying drawings, in which.

Figure 1:
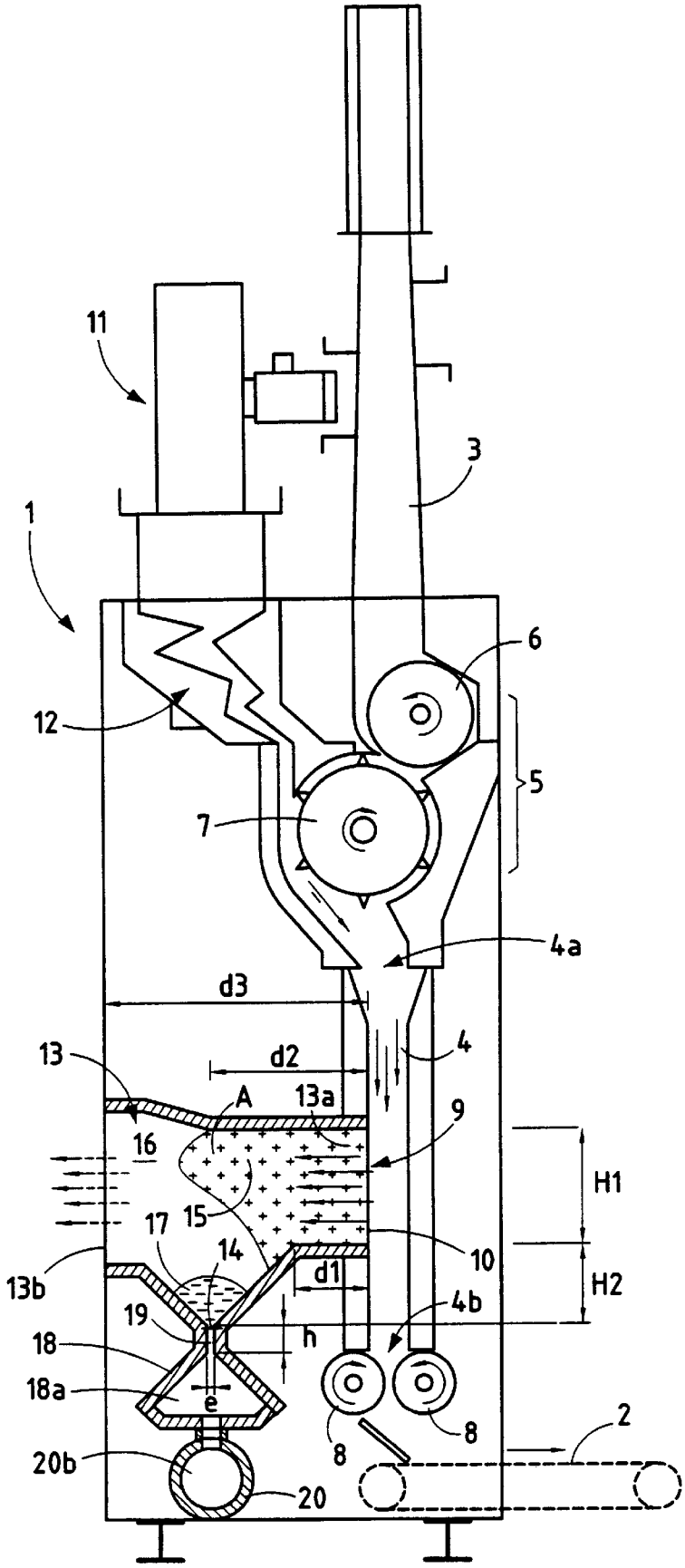
FIG. 1 is a diagrammatic side view of apparatus for forming a lap of stock fibers and implementing an expansion chamber in accordance with the invention.

The apparatus 1 of FIG. 1 serves to form a lap of stock fibers which is received at its outlet, e.g. on a conveyor 2 (shown in dashed lines) enabling the lap of stock fibers that is formed to be conveyed continuously to a textile machine such as a card, for example (not shown). The apparatus has two vertical chimneys positioned substantially in line with each other, a top or "reserve" chimney 3 and a bottom or "feed" chimney 4. In the intermediate zone 5 between the two chimneys 3 and 4, a feed cylinder 6 and an opening cylinder 7 are rotatably mounted and in the particular example shown they rotate in opposite directions. The bulk fiber material is loaded, e.g. pneumatically, into the top portion of the reserve chimney 3, and falls under gravity to the feed cylinder 6 where it is shredded by the opening cylinder 7, being taken to the open top end 4*a* of the feed chimney 4. At its opposite, bottom end 4*b*, the feed chimney 4 is also open. At the outlet from this open bottom end 4*b*, there are mounted two rotary feed rolls 8 which take up the stock fiber material from the bottom portion of the feed chimney 4 to deliver it to the outlet from the apparatus 1.

The width of the feed chimney 4 corresponds to its dimension in a plane extending transversely to the plane of FIG. 1. In practice, the length of the feed rolls 8 is substantially equal to said width, and the lap of stock fibers delivered onto the conveyor 2 at the outlet form the apparatus 1 is of a width that is substantially equal to the width of the feed chimney 4.

Figure 2:
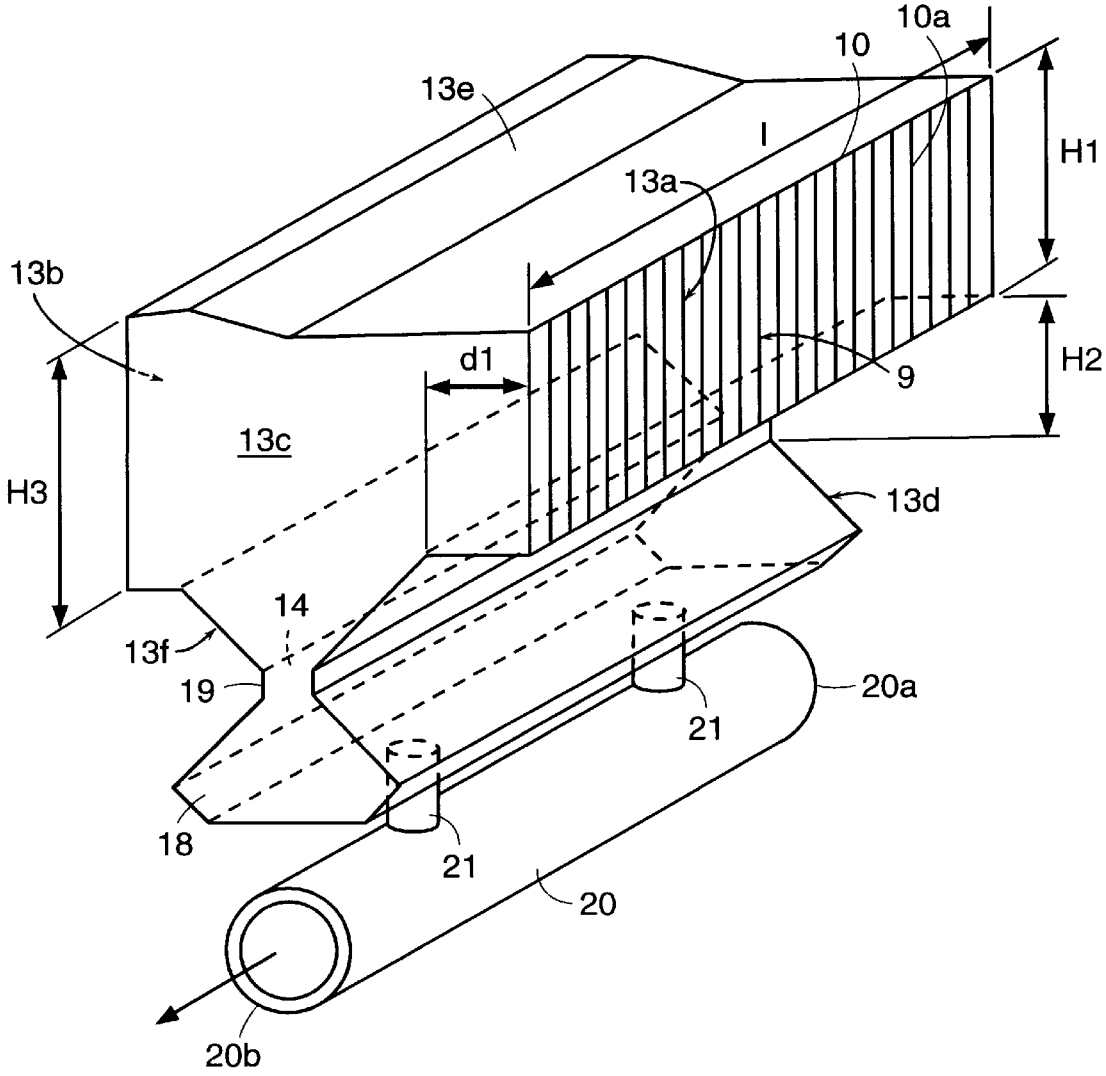
FIG. 2 is a perspective view of the expansion chamber of the apparatus shown in FIG. 1.

With reference to FIG. 1, the feed chimney 4 also has, upstream from the feed rolls 8, an exhaust outlet 9 having a grid 10 mounted thereover. With reference to FIG. 2, the exhaust opening 9 is substantially rectangular in shape being of width l and of height $H_1$. In the particular embodiment shown, the grid 10 comprises a plurality of vertical bars 10*a* which, in pairs, define a plurality of exhaust openings that are distributed across the entire width l. In practice, this width l corresponds preferably substantially to the width of the feed chimney 4. In another variant, the grid 10 could be omitted, or replaced by a perforated plate.

At least one fan 11 is provided in the top portion of the apparatus 1 to blow a flow of densification air inside the feed chimney 4. In the example shown, this flow of air is fed into the feed chimney 4 via the top end 4*a* thereof. In another variant, this flow of densification air could be fed into the feed chimney via some other point in its upper portion situated above the level of the exhaust opening 9. Immediately at the outlet from the fan 11, there is also provided a baffle system 12 which provides successive deflecting panels to break the fan-driven flow of air, thereby ensuring that the flow of densification air at the inlet is distributed uniformly over the entire width of the feed chimney 4.

The flow of densification air inside the feed chimney 4 serves to accelerate towards the feed rolls 8 the fiber material that is inserted into the feed chimney 4, which fiber material accumulates above the two feed rolls 8. The flow of densification air is exhausted from above the level of the fiber material via the exhaust opening 9.

The exhaust opening 9 communicates with an expansion chamber 13 which is provided with an opening 14 for taking up the air inside the expansion chamber 13 by suction.

In the example shown in FIGS. 1 and 2, the takeup opening 14 is in the form of a narrow slot of width e and of length substantially equal to the width l, extending parallel to the exhaust grid 10, i.e. parallel to the width of the feed chimney 4. In another variant, the slot 14 could be replaced by a plurality of small-section air takeup openings that are distributed across the width l of the expansion chamber. This opening 14 in the form of a slot communicates with a manifold 18 via a rectilinear channel 19 of height h. The manifold 18 and the rectilinear channel 19 define an air distribution chamber 18*a*. The inside volume of the manifold 18 and the section of the slot-shaped air takeup opening 14 are selected so that the head loss in the air flow sucked through the slot 14 is large and greater than the head loss inside the manifold 18, thereby making it possible to obtain a good distribution of suction flow through the slot over the entire length of the slot 14. A suction flow through the slot 14 is thus established which is advantageously distributed in substantially uniform manner over the entire width l of the expansion chamber 13. For a given section of the slot 14, the inside volume of the manifold 18 is preferably large so that the head loss through the slot 14 is at least ten times greater than the head loss within the manifold 18.

The bottom of the manifold 18 communicates for suction purposes with a cylindrical endpiece 20, e.g. via two couplings 21. The endpiece 20 has a closed end face 20*a* and an open end face 20*b* through which the sucked-out air is exhausted.

Figure 3:
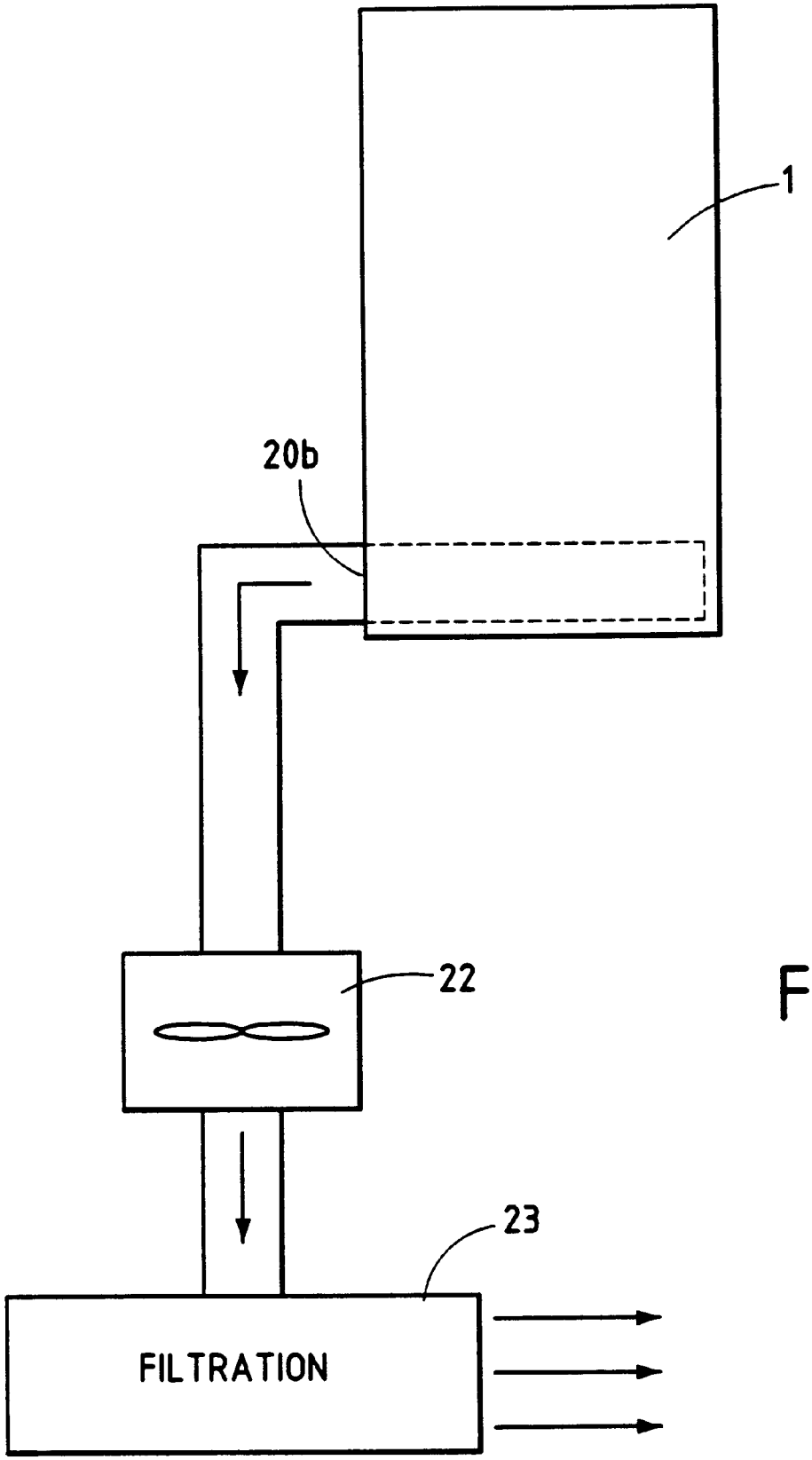
FIG. 3 is a block diagram showing a particular example of how the densification air sucked from the outlet of the FIG. 1 apparatus can be recycled into ambient air.

With reference to FIG. 3, suction through the slot 14, the manifold 18, and the endpiece 20 is set up by means of a fan 22 connected to the open end face 20*b* of the endpiece 20. At the outlet from the fan 22, air coming from the apparatus 1 is directed to a filter system 23, e.g. a system of bag filters for removing dust and residual fibers carried by the air. At the outlet from the filter cylinder 23, the air is released into ambient air. In a variant embodiment, the air from the endpiece 20 can be recycled in a closed circuit within the apparatus 1. Under such circumstances, the outlet 20*b* of the endpiece 20 is connected directly to the inlet of the fan 11.

Preferably, the volume of the expansion chamber 13 is sufficiently large and the suction takeup opening 14 is sufficiently far away from the exhaust opening 9 to establish a buffer zone A inside the expansion chamber 13, which buffer zone extends over the entire width l and at least over the entire height $H_1$ of the exhaust opening 9, and in which the air from the feed chimney 4 is subjected to expansion so that air speed within the buffer zone A decreases until it reaches a residual value that is small.

In the particular example of FIG. 1, the buffer zone A can be subdivided into two zones 15 and 16. In the first zone 15, the flow of air coming from the feed chimney 4 is a flow that is substantially parallel, the speed vectors in this air flow being oriented substantially parallel to one another over the entire width l and over the entire height $H_1$ of the exhaust openings, and the magnitude thereof decreases with increasing distance from the exhaust opening 9 going towards the second zone 16. In the second zone 16, the air flow speeds reach low residual values such that it can be considered that the air inside the expansion chamber is approximately at rest in the second zone 16.

The suction which is established through the takeup opening 14 gives rise inside the expansion chamber 13 to a third zone 17 at reduced pressure which is separated from the first zone 15 by the zone 16, and which causes a flow of air to be accelerated towards the takeup slot 14.

It will be understood from the above explanation that the substantially parallel flow of air coming from the feed chimney 4 is undisturbed by the suction flow as created by the low pressure zone 17 in the vicinity of the takeup slot 14. The suction created through the takeup slot 14 therefore does not disturb the orientation and the speed of the parallel air flow through the exhaust grid 10 and has no significant influence on the distribution of the densification air flow inside the feed chimney 4, and consequently on the uniformity of the lap of fibers produced at the outlet from the apparatus 1. Everything takes place as though the densification air flow were escaping freely from the feed chimney 4 through the exhaust opening 9 without being disturbed by the suction established through the takeup slot 14.

It is up to the person skilled in the art to adapt the shape and the dimensions of the expansion chamber 13 and the position of the suction takeup opening 14 as a function mainly of the section of the exhaust opening 9 (width l, height $H_1$), of the flow rate of the fan 11, of the section of the takeup opening 14, of the speed of the air flow through said takeup opening, and of the residual air speed that is to be reached in the zone 16.

In the particular embodiment shown in FIGS. 1 and 2, the expansion chamber 13 has a front face 13*a* constituted by the exhaust grid 10, a rectangular rear face 13*b* of width l and of height $H_3$ greater than the height $H_1$ of the front face 13*a*, two vertical side walls 13*c* and 13*d*, a top wall 13*e*, and a bottom wall 13*f*. The expansion chamber 13 essentially comprises a first portion of constant section identical to the section of the exhaust opening 9 and extending from the exhaust opening 9 over a length $d_1$, and a second portion having firstly in a vertical plane a section that is greater that the section ($l \times H_1$) of the first portion, and secondly a volume greater than the volume of the first portion. This second portion extends to the rear face 13*b* which is situated at a distance $d_3$ from the exhaust opening 9. More particularly, in the second portion of the expansion chamber 13, the bottom wall 13*f* forms a substantially V-shape funnel with the suction takeup opening 14 being provided in the bottom thereof. The air takeup opening 14 is therefore not situated in line with the first portion of constant section of the expansion chamber 13, but is offset in a vertical plane away from the exhaust opening 9. With reference to FIG. 1, the takeup opening 14 is offset from the exhaust opening 9 by a distance $d_2$ taken in a horizontal plane and by a distance $H_2$ taken in a vertical plane. In a particular embodiment given purely by way of indication, the width l was 2500 mm. The air flow from the fan 11 in normal operation, i.e. once the feed chimney was full of fiber material, was 2200 $m^3$/h. The average speed of the air flow through the exhaust grid 10 through parts of the grid unencumbered by fibers was about 6 m/s to 7 m/s. The air flow speed through the exhaust grid as measured at a given height was substantially uniform over its entire width l, with differences in speed being no greater than 5%. The speed of the air flow sucked through the slot 14 was substantially uniform over the entire length of the slot and was about 30 m/s. The total volume of the expansion chamber 13 was about 0.5 $m^3$. The distances $d_1$, $d_2$, and $d_3$ were respectively 170 mm, 370 mm, and 605 mm. The heights $H_1$, $H_2$, and $H_3$ were respectively 232 mm, 200 mm, and 420 mm. The width e of the slot 14 was about 8 mm. The height h of the channel 19 was about 48 mm. The volume of the manifold 18 was about 0.03 $m^3$. The air speed of the outlet from the feed chimney 4 dropped so that on reaching the zone 16 the residual speed Vr was less than or equal to 1.5 m/s. More precisely, inside the zone 16, the residual air speeds were not uniform but were larger at greater height, i.e. in the portion of the zone that is in register with the exhaust opening 9. Overall, the average air speed in the second zone 16 was estimated at 0.5 m/s.

In a variant embodiment, it is also possible to provide air exhaust orifices in the rear face 13*b* of the expansion chamber 13 to put the inside of the chamber 13 into communication with the atmosphere outside the apparatus 1 and to provide a filter medium over said orifices. These exhaust orifices serve advantageously during an initial stage of loading the feed chimney 4 so as to make it possible to operate at an air flow rate that is greater than that which obtains during the second stage of operation once the feed chimney 4 has been loaded, with surplus air being evacuated automatically through the orifices in the rear wall 13. Once the feed chimney 4 has been loaded, i.e. when the material inside the chimney 4 has reached a predetermined level, then operation takes place with a lower operating air flow rate, and all of the air delivered by the fan 11 is exhausted via the slot 13 by using the fan 22.

What is claimed is:

1. An apparatus for forming a lap of stock fibers comprising a feed chimney open at top and bottom ends, an expansion chamber having a cross-sectional area and communicating with the feed chimney via at least one exhaust opening having a width, means for taking up the air by suction from inside the expansion chamber comprising an air distribution manifold chamber having a cross-sectional area and designed to be put at reduced pressure and communicating with the expansion chamber via an air takeup slot having a cross-sectional area smaller than the cross-sectional area of the expansion chamber and the cross-sectional area of the air distribution manifold chamber, means enabling the feed chimney to be fed with stock fiber material via the open top end, means of the feed roll type for taking up the stock fiber material and disposed at the open bottom end of the feed chimney, and means for establishing a force flow of densification air between the top end of the feed chimney and the at least one exhaust opening.

2. The apparatus according to claim 1, further comprising a buffer zone inside the expansion chamber substantially at the at least one exhaust opening, which buffer zone extends substantially over the at least one exhaust opening, and in which the air from the feed chimney, having an air speed, is subjected to expansion so that the air speed in the buffer zone decreases going away from the at least one exhaust opening.

3. The apparatus according to claim 2, wherein the expansion chamber is designed so that the air speed in the buffer zone reaches a residual value that is not more than 1.5 m/s.

4. The apparatus according to claim 1, wherein the at least one exhaust opening has a height and the expansion chamber having a width, height, and volume, comprise a first portion of substantially constant width and height substantially identical to the width and height of the at least one exhaust opening and extending from the at least one exhaust opening over a length, and a second portion with which the air takeup slot is in communication and which has a volume that is greater than the volume respectfully of the first portion.

5. The apparatus according to claim 4, wherein the air takeup slot is offset in a vertical plane relative to the at least one exhaust opening.

6. The apparatus according to claim 1, wherein the air takeup slot extends substantially over the entire width of the at least one exhaust opening.

7. The apparatus according to claim 1, wherein the expansion chamber has a front wall containing the at least one exhaust opening and a back wall spaced opposite the front wall and having a height, wherein the front wall has a height less than the height of the back wall.

8. An apparatus for forming a lap of stock fibers comprising:

(a) a feed chimney open at top and bottom ends;

(b) an expansion chamber having a cross-sectional area and communicating with the feed chimney via at least one exhaust opening having a width;

(c) means for taking up the air by suction from inside the expansion chamber comprising an air distribution manifold chamber having a cross-sectional area and designed to be put at reduced pressure and communicating with the expansion chamber via a plurality of air takeup openings, wherein the plurality of air takeup openings have a cross-sectional area smaller than the cross-sectional area of the expansion chamber and the cross-sectional area of the air distribution manifold chamber;

(d) means enabling the feed chimney to be fed with a stock fiber material via its open top end;

(e) means of the feed roll type for taking up the stock fiber material and disposed at the open bottom end of the feed chimney; and (f) means for establishing a forced flow of densification air between the top end of the feed chimney and the at least one exhaust opening.

9. The apparatus according to claim 8, further comprising a buffer zone inside the expansion chamber substantially at the at least one exhaust opening, which buffer zone extends substantially over the at least one exhaust opening, and in which the forced flow of densification air, having an air speed, is subjected to expansion so that air speed in the buffer zone decreases going away from the at least one exhaust opening.

10. The apparatus according to claim 9, wherein the expansion chamber is designed so that the air speed in the buffer zone reaches a residual value that is not more than 1.5 m/s.

11. The apparatus according to claim 8, wherein the at least one exhaust opening has a height and the expansion chamber comprises a first portion, having a width, height, and volume, of substantially constant width and height substantially identical to the width and height of the at least one exhaust opening and extending from the at least one exhaust opening over a length, and a second portion with which the plurality of air takeup are in communication and which has a volume that is greater than the volume of the first portion.

12. An apparatus for forming a lap of stock fibers comprising:

(a) a feed chimney open at top and bottom ends communicating with a stock fiber feed device at its top end and communicating with a feed roll device at its bottom end;

(b) an expansion chamber having a cross-sectional area and communicating with the feed chimney via at least one exhaust opening having a width;

(c) an air suction device comprising an air distribution manifold chamber having a cross-sectional area, designed to be put at reduced pressure, and communicating with the expansion chamber via at least one air takeup opening, wherein the at least one air takeup opening is spaced downstream of the air flow from the at least one exhaust opening and has a cross-sectional area smaller than the cross-sectional area of the expansion chamber and the cross-sectional area of the air distribution manifold chamber; and (d) an air flow device creating an air flow from the top end of the feed chimney towards the at least one exhaust opening.

13. The apparatus of claim 12, further comprising a buffer zone inside the expansion chamber substantially at the at least one exhaust opening, which buffer zone extends substantially over the at least one exhaust opening, and in which the air from the feed chimney, having an air speed, is subjected to expansion so that the air speed in the buffer zone decreases going away from the at least one exhaust opening.

14. The apparatus according to claim 12, wherein the at least one exhaust opening has a width and the at least one air takeup opening extends substantially over the entire width of the at least one exhaust opening.

15. The apparatus according to claim 12, wherein the expansion chamber has a front wall containing the at least one exhaust opening and a back wall opposite the front wall and having a height, wherein the front wall has a height less than the height of the back wall.

16. An apparatus for forming a lap of stock fibers comprising:

(a) a feed chimney open at top and bottom ends communicating with a stock fiber feed device at the top end and communicating with a feed roll device at the bottom end;

(b) an expansion chamber having a cross-sectional area and communicating with the feed chimney via at least one exhaust opening having a width;

(c) an air flow device creating an air flow from the top end of the feed chimney towards the at least one exhaust opening and wherein the air flow, having a velocity and direction, has a substantially constant direction in the expansion chamber until the air flow velocity is substantially small; and (d) an air suction device comprising an air distribution manifold chamber, having a cross-sectional area, designed to be put at reduced pressure, and communicating with the expansion chamber via at least one air takeup opening, wherein the at least one air takeup opening is spaced downstream of the air flow from the at least one exhaust opening and has a cross-sectional area smaller than the cross-sectional area of the expansion chamber and the cross-sectional area of the air distribution manifold chamber.

17. The apparatus according to claim 16, further comprising a buffer zone inside the expansion chamber substantially at the at least one exhaust opening, which buffer zone extends substantially over the at least one exhaust opening, and in which the air flow is subjected to expansion so that the air flow velocity in the buffer zone decreases going away from the at least one exhaust opening.

18. The apparatus according to claim 17, wherein the expansion chamber is designed so that the velocity of the air flow in the buffer zone reaches a residual value that is not more than 1.5 m/s.

19. The apparatus according to claim 16, wherein the air flow direction in the expansion chamber is substantially uniform across the width of the expansion chamber.

20. The apparatus according to claim 16, wherein the air flow through the at least one air takeup opening has a velocity that is substantially uniform across a width of the at least one air takeup opening.

* * * * *